US005236654A

United States Patent [19]

Adams et al.

[11] Patent Number: 5,236,654

[45] Date of Patent: Aug. 17, 1993

[54] BAR STAMPING

[75] Inventors: Michael J. Adams; Brian Edmondson, both of South Wirral, England

[73] Assignee: Lever Brothers Company, New York, N.Y.

[21] Appl. No.: 781,133

[22] PCT Filed: Jun. 25, 1990

[86] PCT No.: PCT/GB90/00972

§ 371 Date: Dec. 26, 1991

§ 102(e) Date: Dec. 26, 1991

[87] PCT Pub. No.: WO91/00338

PCT Pub. Date: Jan. 10, 1991

[30] Foreign Application Priority Data

Jun. 27, 1989 [GB] United Kingdom ..... 8914686

[51] Int. Cl.[5] ..... C11D 13/16; B30B 15/34

[52] U.S. Cl. ..... 264/320; 425/384; 425/407

[58] Field of Search ..... 264/320, 28; 425/384, 425/DIG. 9, 407, 408

[56] References Cited

U.S. PATENT DOCUMENTS

| | | | |
|---|---|---|---|
| 2,987,484 | 6/1961 | Lundberg | 252/484 |
| 3,271,834 | 9/1966 | Mazzoni . | |
| 3,449,804 | 6/1969 | Moses et al. | 264/320 |
| 3,907,486 | 9/1975 | Kennedy | 425/408 |
| 4,067,946 | 1/1978 | Rickert | 264/320 |
| 4,278,230 | 7/1981 | Allen | 249/81 |

FOREIGN PATENT DOCUMENTS

| | | |
|---|---|---|
| 0072996 | 2/1983 | European Pat. Off. . |
| 1467709 | 1/1969 | Fed. Rep. of Germany . |
| 1388996 | 12/1965 | France . |

*Primary Examiner*—Jill L. Heitbrink
*Attorney, Agent, or Firm*—Ronald A. Koatz

[57] ABSTRACT

The stamping of soap and/or detergent bars using liquid-cooled co-acting die members is carried out using turbulent flow of liquid coolant in order to reduce die blocking.

3 Claims, No Drawings

BAR STAMPING

The present invention relates to the stamping of soap and/or detergent bars. By "soap and/or detergent" bars we means both toilet and laundry bars made from conventional soap (ie. alkali metal salts of long chain monocarboxylic acids) or non-soap detergents or a mixture of soap and non-soap detergents. "Bars" includes cakes, tablets and the like. For convenience the bars will generally be referred to below as "soap bars".

Stamping of soap bars is traditionally performed on extruded billets in order to produce bars having a pleasing and uniform appearance. The stamping operation using pairs of co-acting die members can however be a frequent source of problems on a production line. A potential major problem is die blocking which results in imperfections appearing in the stamped bars due to small amounts of soap sticking to the stamping surface of the die members. A number of solutions to this problem have been proposed over the years but none has proved totally satisfactory.

It has for example been the practice of the applicants to operate die chilling techniques in their soap bar production lines. Such a practice has traditionally been accepted as an aid to improving the stamping of soap bars. Die blocking still however occurs to a high enough level to effect the output of acceptable soap bars. The coolant frequently used has been 50% aqueous glycol solution at a temperature of between −30° and −20° C. Such a system did produce some sort of benefit. Little attention has however been paid to the rationale and overall effectiveness for the chilling system that has been employed over the years either by ourselves or we believe by other soap manufacturers.

For example U.S. Pat. No. 2,987,484 (The Procter & Gamble Company) dates from 1959 and relates to a process for closed die molding in which a fluid mixture of synthetic detergent and a binder vehicle is injected into a closed die and forms a strong shape retaining shell in a substantially closed precooled mould. After solidification to at least a shape-sustaining form the bar is ejected from the mould for further cooling as necessary. The mould is said to be suitably precooled to a temperature in the range of about −30° F. to about +40° F. (−34° to +4° C.) and preferably to a temperature in the range of about −10° F. to about +30° F. (−23° to −1° C.) for optimum results, such as minimum tendencies for the bar compositions to stick, crack or require long holding times in the mould. The optimum mould temperature within this range varies with the composition of the melt, the melting point of the mix, and the temperature of the melt as it is injected into the mould. U.S. Pat. No. 2,987,484 is thus concerned with the particular problems associated with the closed die molding of fluid mixtures. It is noteworthy however that no details are given about the operation of the cooling system applied to the mould.

According to the present invention there is provided a process for stamping soap and/or detergent bars using Co-acting die members wherein a liquid coolant is circulated through tubes, having a diameter within the range 2 to 20 mm, formed within the die members, characterised in that the liquid is circulated through the die members under turbulent flow conditions.

Turbulent flow conditions can be achieved in a number of ways. Preferably the turbulent flow conditions are achieved by use of a high throughput pump. Alternatively or additionally turbulent flow conditions can be achieved by use of die members having tubes with a diameter less than a predetermined width. Suitably the throughput of coolant through tubes having a diameter within the range to 2 to 20 mm in the die members, in order to achieve turbulent flow conditions, should be within the range 100 to 10,000 liters/hour. A typical flow rate will lie in the range 150 to 4000 liters/hour while the flow velocity is 2 to 10 meters/sec (contrasting with 0.2 meters/sec for laminar flow). Stated more generally it is desirable that the linear flow rate is at least 1 meter/sec, better more than this such as more than 2 meters/second.

The actual throughput of coolant will vary from case to case and in particular will depend on the coolant employed. In order to achieve turbulent flow relying primarily on the use of narrow tubes, tubes having diameters within the range 3 to 15 mm are preferred. The actual tubular design chosen will depend inter alia on the coolant selected. Examples of suitable coolants include aqueous brine, aqueous glycol, methanol and propylene glycol. The tubes within the die members may be of any cross-sectional shape eg. circular, rectangular and can be non-uniform and can include chambers.

It will be desirable to bring about turbulent flow conditions for at least a majority, preferably substantially all of the flow length through the die members. Localised regions of turbulent flow merely give rise to localised cold spots rather than uniform cooling of the die surface.

It will be desirable to design the die members so as to minimise localised flow restrictions, which can create localised zones of high turbulence and resistance to flow. To provide a high volumetric coolant flow rate without unduly enhancing the flow pressure, it is desirable to avoid flow restrictions as just mentioned and also choose a coolant of low viscosity. In the case of aqueous coolants it is desirable to use the minimum fraction of anti-freeze, e.g. glycol. Preferably an anti-freeze is chosen which leads to a low viscosity of the coolant mixture. Methanol is suitable. There are a number of options for low viscosity non-aqueous coolants including mineral oils, aromatic organic solvents and silicone fluids. Alkylated benzenes are particularly suitable.

By use however of turbulent flow conditions it has been found possible both to maintain the temperature at the die surface at an optimum temperature for good die release between the soap bar being stamped and the die itself and to achieve such an optimum temperature across the die surface. A sufficiently low temperature to achieve optimal release will vary from one composition of soap bar to another. Nonetheless by use of turbulent flow conditions it has proved possible to achieve a reduced occurrence of die blocking. Use of turbulent flow conditions for the circulating coolant can also result in it being possible to achieve energy savings with regard to the temperature required in the coolant itself. Because cooling is more effective when turbulent flow is used, the temperature differential between the coolant and the die surface temperature can be less, which promotes uniformity of the die surface temperature.

For example Table 1 below sets out the results of measurements performed on respectively, a relatively easy to stamp superfatted toilet soap bar and a relatively difficult to stamp household soap bar. The figures set out in the table are (left column) surface temperature in ° C of a punch indented into each soap bar, at a constant velocity while the soap bar is at 40° C. and (right column) the release force in Newtons needed to remove the punch. As can be seen for the superfatted toilet soap a decrease in the release force, which will be related to the adhesive force between the punch surface and the soap bar surface, occurs with decreasing temperature. A similar result was observed for the household soap when the punch temperature was below 20° C.

TABLE 1

| Punch Temp T, °C. | Superfatted toilet soap F, N | Punch Temp T, °C. | Household soap F, N |
|---|---|---|---|
| 4 | 3.4 | 1 | 2.0 |
| 10 | 3.4 | 6 | 5.1 |
| 20 | 12.1 | 11 | 4.7 |
| 30 | 10.9 | 13 | 3.5 |
| 40 | 25.2 | 20 | 35.5 |
| 60 | 28.3 | 28 | 35.2 |
| | | 39 | 27.3 |
| | | 48 | 24.6 |

It is therefore important in order to achieve an effective reduction in die blocking that the actual die surface is at a low enough temperature, in order to effect a reduction in temperature of the soap bar surface.

Although die chilling using a coolant at about −20° C. has been practiced by the applicants in the past it had not been appreciated until the present invention that using the system selected by the factory engineers achieved average die surface temperatures of approximately 15° C. with a wide distribution of temperatures across the die surface. It is only with the present invention that it was realised that sufficiently low and uniform die surface temperatures could be achieved to bring about a significant decrease in die blocking of the finished stamped soap bars.

The actual die surface temperature required will vary from case to case. Not only will a desirable die surface temperature depend on the composition of the soap bar being stamped having regard to the adhesive force pertaining between the die member surface and the soap composition in question, but it will also depend on the throughput through the stamping machine. As the important parameter to achieve is the actual surface temperature of the soap bar, it is necessary to remove heat from the soap bar surface by contact with the suitably chilled die members. As the throughput increases the contact time between the soap bar and the die member decreases and it may be necessary to reduce the temperature of the die surface in order to achieve the same amount of heat removal from otherwise equivalent soap bars. We have for example found that effective die surface temperatures not exceeding +10° C., eg in the range −5° to +5° C. are desirable for stamping the above mentioned superfatted toilet bar at a throughput rate of 60 bars per minute per pair of die members which resulted in a residence contact time with the die members of about 0.2 seconds. We have found that a convenient way to measure the die surface temperature is by high speed thermal imaging.

A trial was carried out on a production line modified so that coolant was circulated through the die members under turbulent flow conditions rather than laminar flow as used beforehand on the line concerned. The production line concerned was used to stamp the superfatted toilet soap referred to previously.

A coolant used was a 35% w/v solution of ethylene glycol in water. It was delivered at −8° C. at a pressure of 930 kN/m$^2$. The volumetric flow rate was measured and from this the linear flow rate through the die was calculated to be 1.4 meters/sec. The die surface temperature was measured using an infra red sensitive video camera and determined to be +8° C. Before the trial took place, it was necessary to interrupt the production line at intervals to rectify die blocks. Moreover, a proportion of the bars produced and judged to be of acceptable quality did nevertheless have minor imperfections resulting from die blocking.

During the trial it was found that there was some reduction in the frequency with which the line needed to be stopped to rectify die blocks. Moreover, the proportion of acceptable bars which displayed noticeable but tolerable imperfections dropped to 10% of production, compared with 20% of production before the trial commenced.

We claim:

1. A process for increasing the throughput rate of soap and/or detergent bars to greater than about 60 bars per minute per pair of die surfaces; which said bars are stamped by the die surfaces of a pair of co-acting die members used to stamp said bars; and which process comprises circulating a liquid coolant through tubes which are formed within said die members;

providing said tubes with a diameter within the range of about 2 to about 20 mm;

circulating said liquid coolant through said tubes at a throughput within the range of about 100 to about 10,000 liters/hr;

cooling the surface of the die members with said liquid coolant to maintain the temperature at the surface of the die members at from about −5° C. to below 10° C.; and contacting each bar with the die members for about 0.2 seconds.

2. A process according to claim 1, wherein the throughput of said liquid coolant is in the range of 150 to 4,000 liters/hours.

3. A process according to claim 1, wherein the linear flow rate of said liquid coolant through the tubes is at least 1 meter/second.

* * * * *